US011387602B2

(12) United States Patent
Ke et al.

(10) Patent No.: US 11,387,602 B2
(45) Date of Patent: Jul. 12, 2022

(54) ELECTRICAL CONNECTOR AND ELECTRICAL WIRE CONNECTION METHOD THEREFOR

(71) Applicant: ADVANCED-CONNECTEK INC., New Taipei (TW)

(72) Inventors: Yu-Feng Ke, New Taipei (TW); Sheng-Hsiang Huang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 17/198,769

(22) Filed: Mar. 11, 2021

(65) Prior Publication Data

US 2021/0288441 A1 Sep. 16, 2021

(30) Foreign Application Priority Data

Mar. 12, 2020 (TW) ..... 109108268

(51) Int. Cl.

| | |
|---|---|
| ***H01R 13/639*** | (2006.01) |
| ***H01R 11/11*** | (2006.01) |
| ***H01R 4/62*** | (2006.01) |
| ***H01R 4/12*** | (2006.01) |

(52) U.S. Cl.

CPC ..... *H01R 13/639* (2013.01); *H01R 4/12* (2013.01); *H01R 4/62* (2013.01); *H01R 11/11* (2013.01)

(58) Field of Classification Search

CPC ..... H01R 13/639; H01R 13/58; H01R 13/02; H01R 13/0249; H01R 13/0252; H01R 13/0263; H01R 4/02; H01R 4/022; H01R 4/024; H01R 4/026; H01R 4/027; H01R 4/028; H01R 43/0249; H01R 43/0256; H01R 43/0263; H01R 33/7628

USPC ..... 439/345

See application file for complete search history.

(56) References Cited

U.S. PATENT DOCUMENTS

| | | | | | |
|---|---|---|---|---|---|
| 3,990,143 | A * | 11/1976 | Dittmann | H01R 4/188 | 29/865 |
| 4,632,496 | A * | 12/1986 | Williams | H01R 13/187 | 439/654 |
| 5,135,418 | A * | 8/1992 | Hatagishi | H01R 13/111 | 439/857 |
| 6,848,922 | B2 * | 2/2005 | Coughlan | H01R 13/53 | 439/181 |

(Continued)

FOREIGN PATENT DOCUMENTS

| | | | |
|---|---|---|---|
| CN | 109103725 | A | 12/2018 |
| KR | 10-2012-0137089 | A | 12/2012 |
| TW | M527639 | U | 8/2016 |

*Primary Examiner* — Harshad G Patel

(74) *Attorney, Agent, or Firm* — Muncy, Geissler, Olds & Lowe, P.C.

(57) ABSTRACT

An electrical connector and an electrical wire connection method for connecting electrical connectors with each other are provided. The electrical connector includes a conductive body, a conductive material, and a cable member. One of two ends of the conductive body includes an insertion portion, the other end of the conductive body includes a wire-connection post, and the wire-connection post has a groove. The conductive material is disposed in the groove. The cable member includes core wires inserted into the groove. The conductive medium is distributed over the space between the core wires and the groove.

17 Claims, 11 Drawing Sheets

(56) References Cited

U.S. PATENT DOCUMENTS

| | | | | |
|---|---|---|---|---|
| 6,955,569 | B2 * | 10/2005 | Baker | H01R 13/18 439/839 |
| 7,789,721 | B1 * | 9/2010 | Burdenko | H01R 13/111 439/857 |
| 7,828,611 | B2 * | 11/2010 | Nakamura | H01R 4/185 439/877 |
| 7,905,755 | B1 * | 3/2011 | Martauz | H01R 4/184 205/133 |
| 8,430,698 | B2 * | 4/2013 | Stewart | H01R 13/187 439/843 |
| 8,851,939 | B2 * | 10/2014 | Bazenas | F16F 1/045 439/840 |
| 9,293,838 | B2 * | 3/2016 | Sakaguchi | H01R 4/183 |
| 9,379,479 | B2 * | 6/2016 | Ohnuma | H01R 4/185 |
| 11,133,634 | B2 * | 9/2021 | Takeda | H01R 43/048 |
| 2003/0162447 | A1 * | 8/2003 | Beloritsky | H01R 13/187 439/843 |
| 2004/0157504 | A1 * | 8/2004 | Fujimoto | H01R 13/03 439/877 |
| 2014/0144016 | A1 * | 5/2014 | Bauer | B23K 26/21 29/863 |
| 2014/0374155 | A1 * | 12/2014 | Tachibana | H01R 13/03 29/862 |
| 2015/0011117 | A1 * | 1/2015 | Oh | H01R 4/185 439/520 |
| 2015/0024641 | A1 * | 1/2015 | Lascelles | H01R 13/187 29/857 |
| 2015/0140856 | A1 * | 5/2015 | Sato | H01R 4/70 439/523 |
| 2015/0140874 | A1 * | 5/2015 | Sakaguchi | H01R 4/62 439/879 |
| 2015/0357738 | A1 * | 12/2015 | Griepenstroh | H01R 43/16 29/874 |

* cited by examiner

ELECTRICAL CONNECTOR AND ELECTRICAL WIRE CONNECTION METHOD THEREFOR

CROSS-REFERENCE TO RELATED APPLICATION

This non-provisional application claims priority under 35 U.S.C. § 119(a) to Patent Application No. 109108268 filed in Taiwan, R.O.C. on Mar. 12, 2020, the entire contents of which are hereby incorporated by reference.

FIELD OF THE INVENTION

The instant disclosure relates to a wire-connection structure, and more particular to an electrical connector and an electrical wire connection method for the connecting electrical connectors with each other.

BACKGROUND

The battery of the electric vehicle can be charged by inserting an electrical connector into the receptacle connector (the socket-type electrical connector) in the electric vehicle. The electrical connector has a standardized shape and five conductive bodies. Therefore, the receptacle connector on the electric vehicle and the electrical connector (the plug-type electrical connector) of the charging gun at the charging station are mated with each other and connected to each other. Specifically, the five conductive bodies (pins) of the plug-type electrical connector are respectively two AC power pins, a ground pin, a proximity detection pin, and a pilot control pin.

SUMMARY OF THE INVENTION

The conductive bodies of the receptacle connector and the conductive bodies of the electrical connector are respectively connected to cable members, the slots of the conductive body and core wires of the cable member are together treated with a cold work compression to allow the conductive media (the conductive body and the cable member) to contact each other for conduction. Hence, an air wall is formed between the slots and end portions of the core wires, thereby forming two separate current paths. As a result, during performing power transmission, the electrical connector has increased resistance, thereby causing the increase of temperature. Moreover, the resistance of the large-current conductive body usually apparently increases when the length of the conductive body increases. Furthermore, when the fastening structure for the connector has a cross section in different geometrical shapes, the fixation structure will have different conductivities. One solution known to the inventor is to make the conductive body with other materials having high conductivity, while the manufacturing cost increases and the structural strength decreases.

One embodiment of the instant disclosure provides an electrical connector. The electrical connector comprises a conductive body, a conductive medium, and a cable member. One of two ends of the conductive body comprises an insertion portion, and the other end of the conductive body comprises a wire-connection post. The wire-connection post has a groove. The conductive medium is disposed in the groove. The cable member comprises a plurality of core wires inserted into the groove. The conductive medium is distributed over a space between the core wires and a space between the core wires and the groove.

In one or some embodiments, the conductive medium is made of metal, and the conductive medium is copper powder.

In one or some embodiments, the conductive medium is a solid medium, a fluid medium, or a gas medium.

In one or some embodiments, a surface of the wire-connection post has a vent hole communicating with the groove.

In one or some embodiments, a geometrical shape is formed on a surface of the wire-connection post through riveting.

In one or some embodiments, an inner side of the groove has a cone-shaped slot, and the conductive medium is disposed in the cone-shaped slot.

Another embodiment of the instant disclosure provides an electrical connector. The electrical connector comprises a conductive body, a conductive medium, and a cable member. One of two ends of the conductive body comprises an insertion portion, and the other end of the conductive body comprises a wire-connection post. The wire-connection post has a groove. The conductive medium is disposed in the groove. The cable member comprises a core wire inserted into the groove. The conductive medium is disposed over a space between the core wire and the groove.

Yet another embodiment of the instant disclosure provides an electrical wire connection method for connecting electrical connectors with each other. The method comprises following steps: providing a conductive medium; filling the conductive medium into a groove of a wire-connection post of a conductive body; inserting a plurality of core wires at one end of a cable member into the groove; twisting and tightening the cable member to fill some of the conductive medium into space between the core wires; and exhausting redundant air and rest of the conductive medium from the groove.

In one or some embodiments, after the step of exhausting redundant air and rest of the conductive medium from the groove, the wire-connection post is riveted to fasten the core In one or some embodiments, an air wall is formed between an inner side of the groove and end portions of the core wires, and the conductive medium is filled in the air wall.

According to one or some embodiments of the instant disclosure, the conductive medium is distributed over spaces between the core wire(s) and the groove, so that the conductive medium is properly distributed in the groove and in contact with the core wire(s). Hence, the spaces are filled by the conductive medium, thereby allowing the whole cross section at the connection portion between the conductive body and the cable member to be conductive. Air is exhausted out of the groove. Accordingly, when the cable member used for large-current performs power transmission, problems of increased resistance and temperature can be effectively solved.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
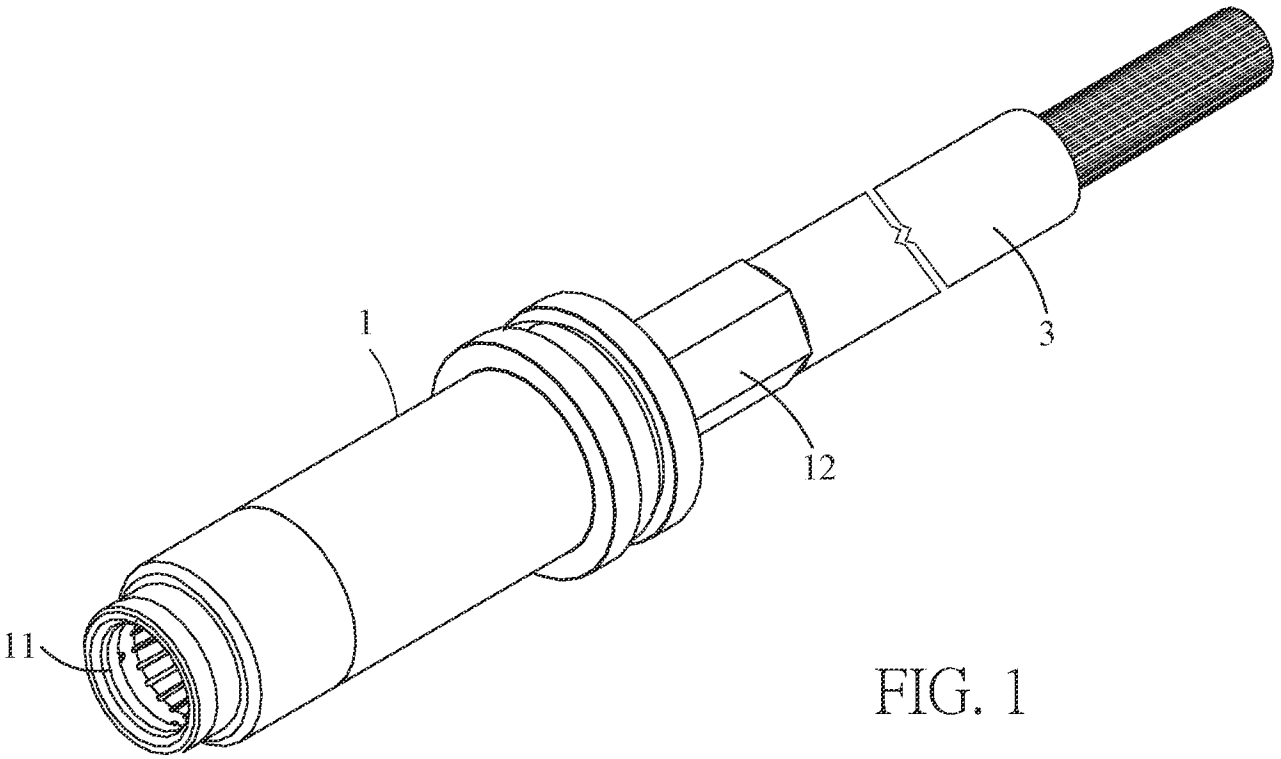
FIG. 1 illustrates a perspective view of a socket-type electrical connector according to a first embodiment of the instant disclosure.
Figure 2:
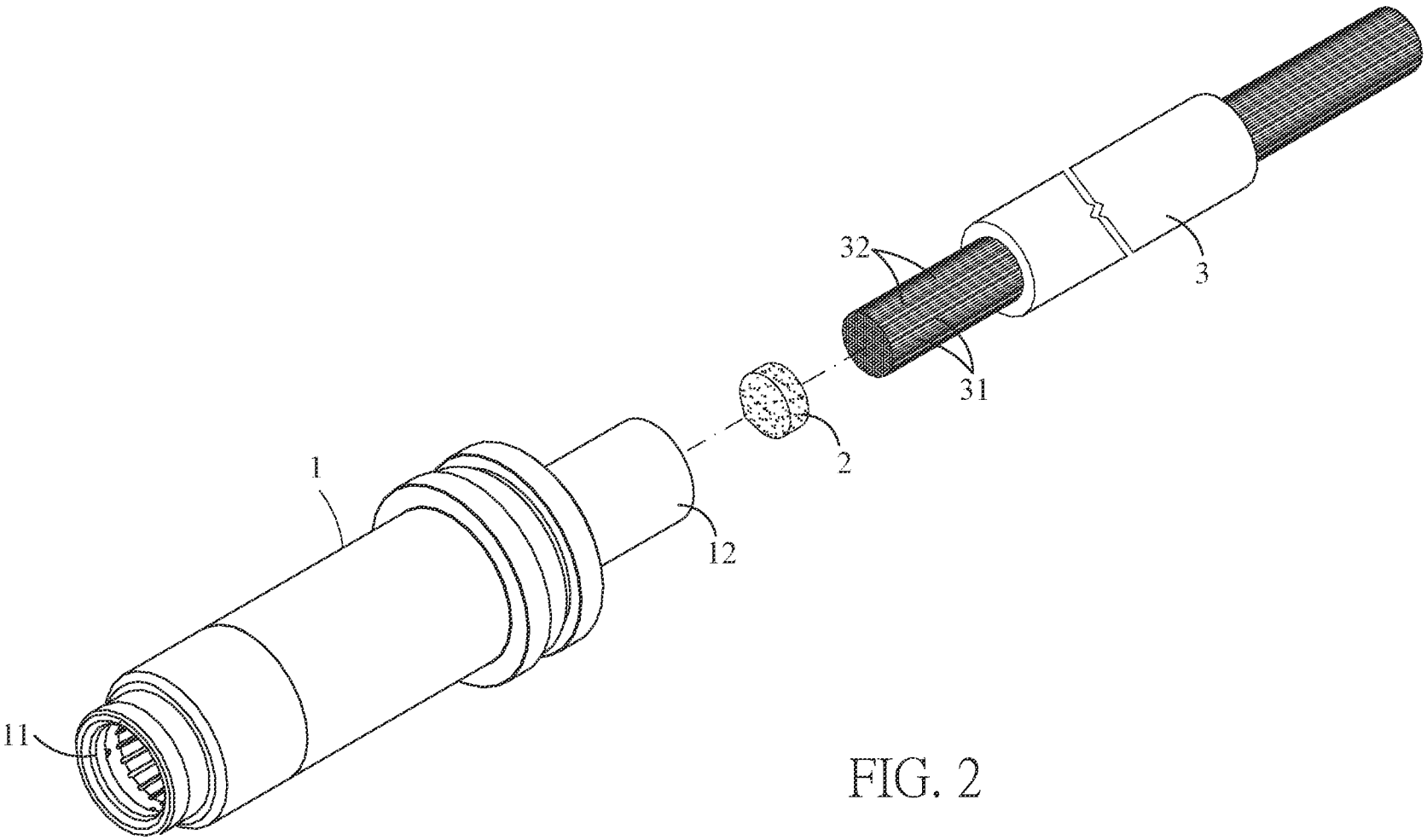
FIG. 2 illustrates an exploded view of the socket-type electrical connector of the first embodiment.
Figure 3:
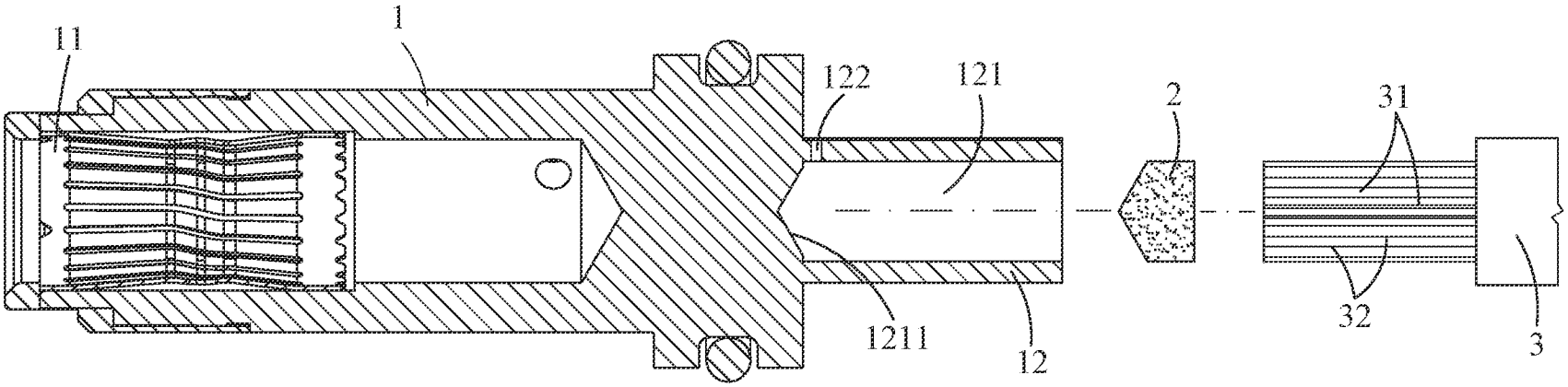
FIG. 3 illustrates a side view showing that the socket-type electrical connector of the first embodiment is to be assembled.
Figure 4:
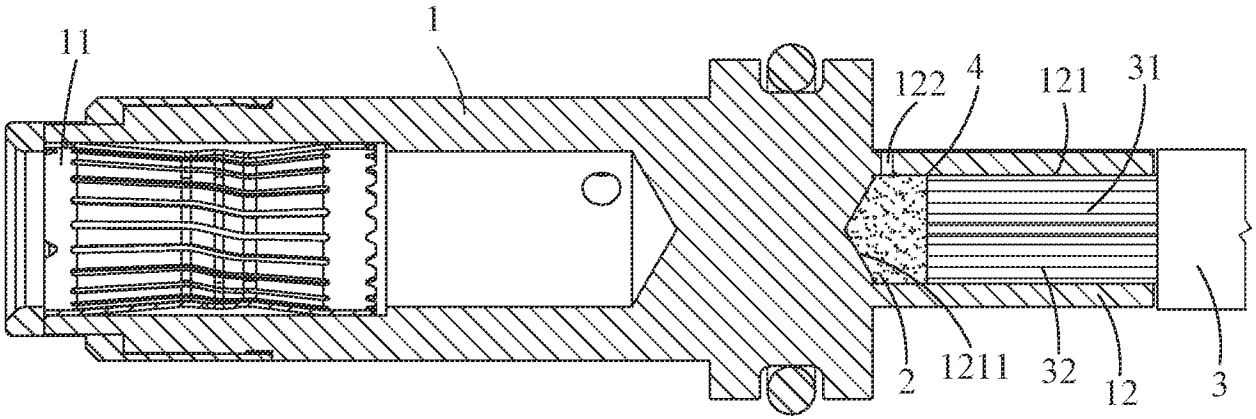
FIG. 4 illustrates a side view showing the socket-type electrical connector of the first embodiment.
Figure 5:
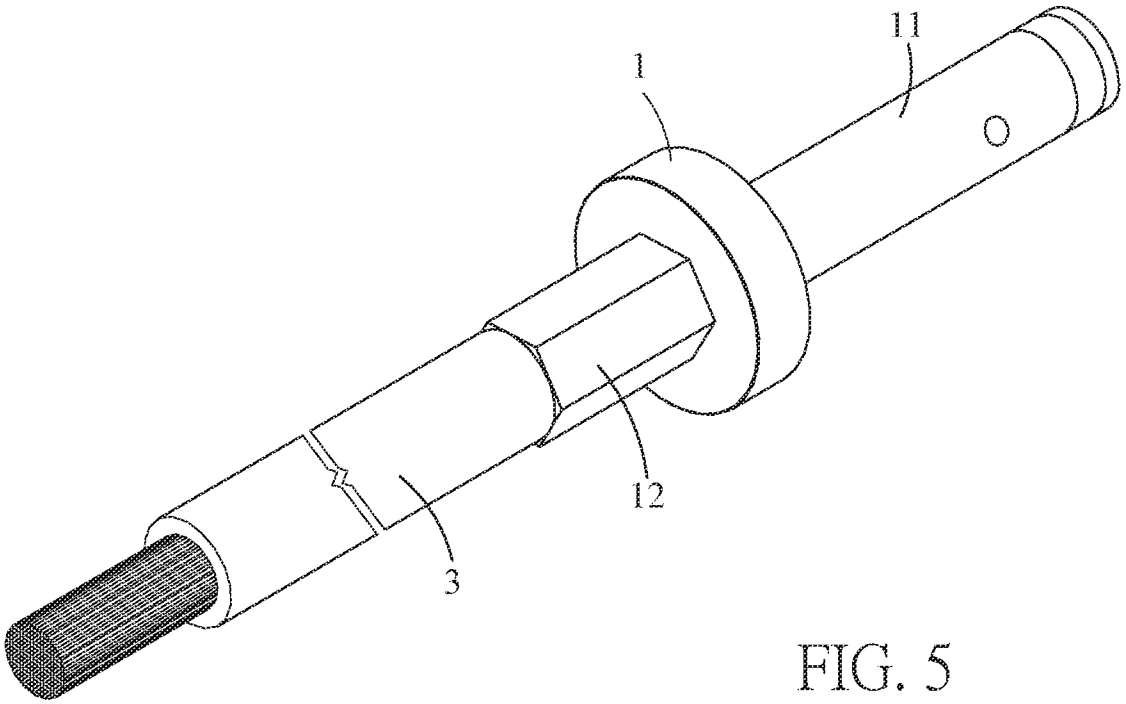
FIG. 5 illustrates a perspective view of a plug-type electrical connector according to a second embodiment of the instant disclosure.
Figure 6:
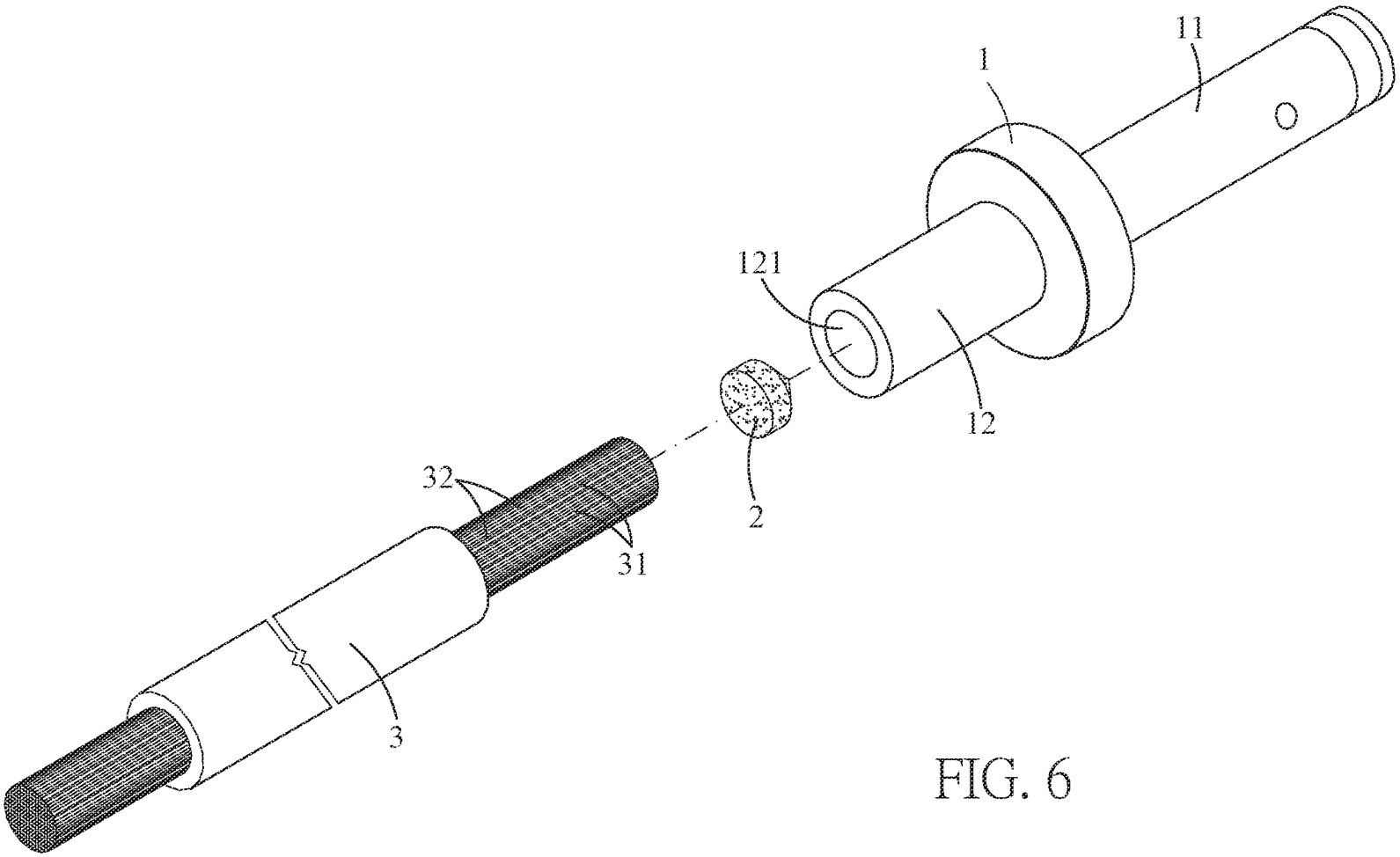
FIG. 6 illustrates an exploded view of the plug-type electrical connector according of the second embodiment.
Figure 7:
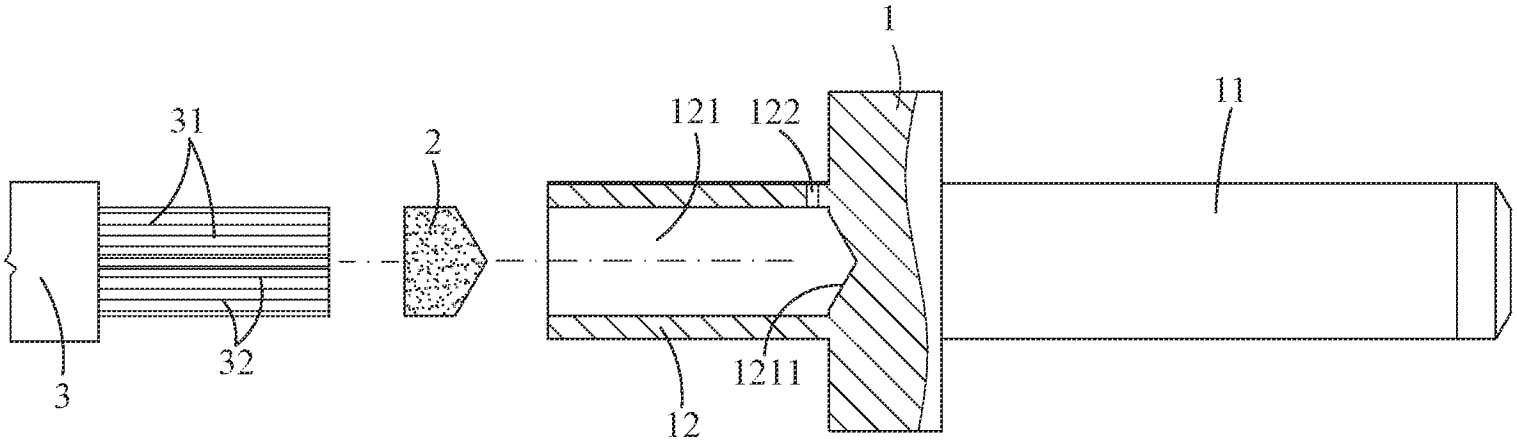
FIG. 7 illustrates a side view showing that the plug-type electrical connector of the second embodiment is to be assembled.
Figure 8:
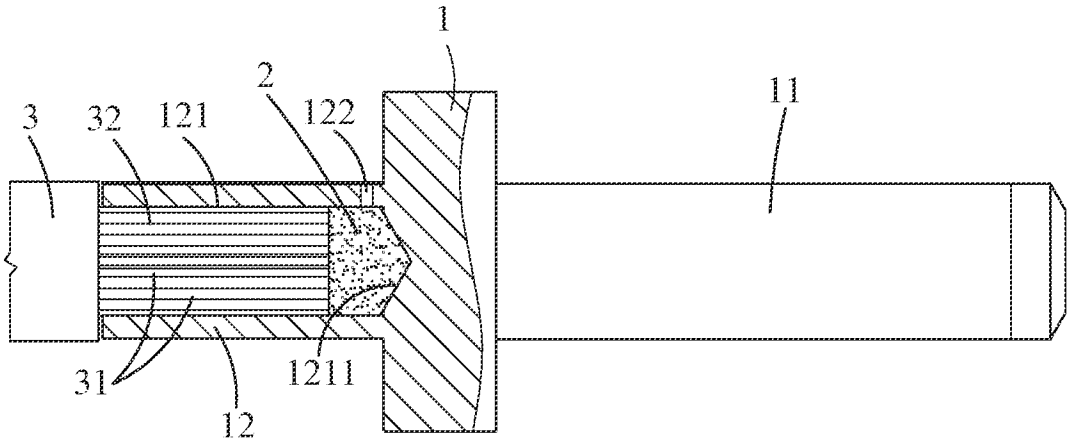
FIG. 8 illustrates a side view showing the assembled plug-type electrical connector of the second embodiment.
Figure 9:
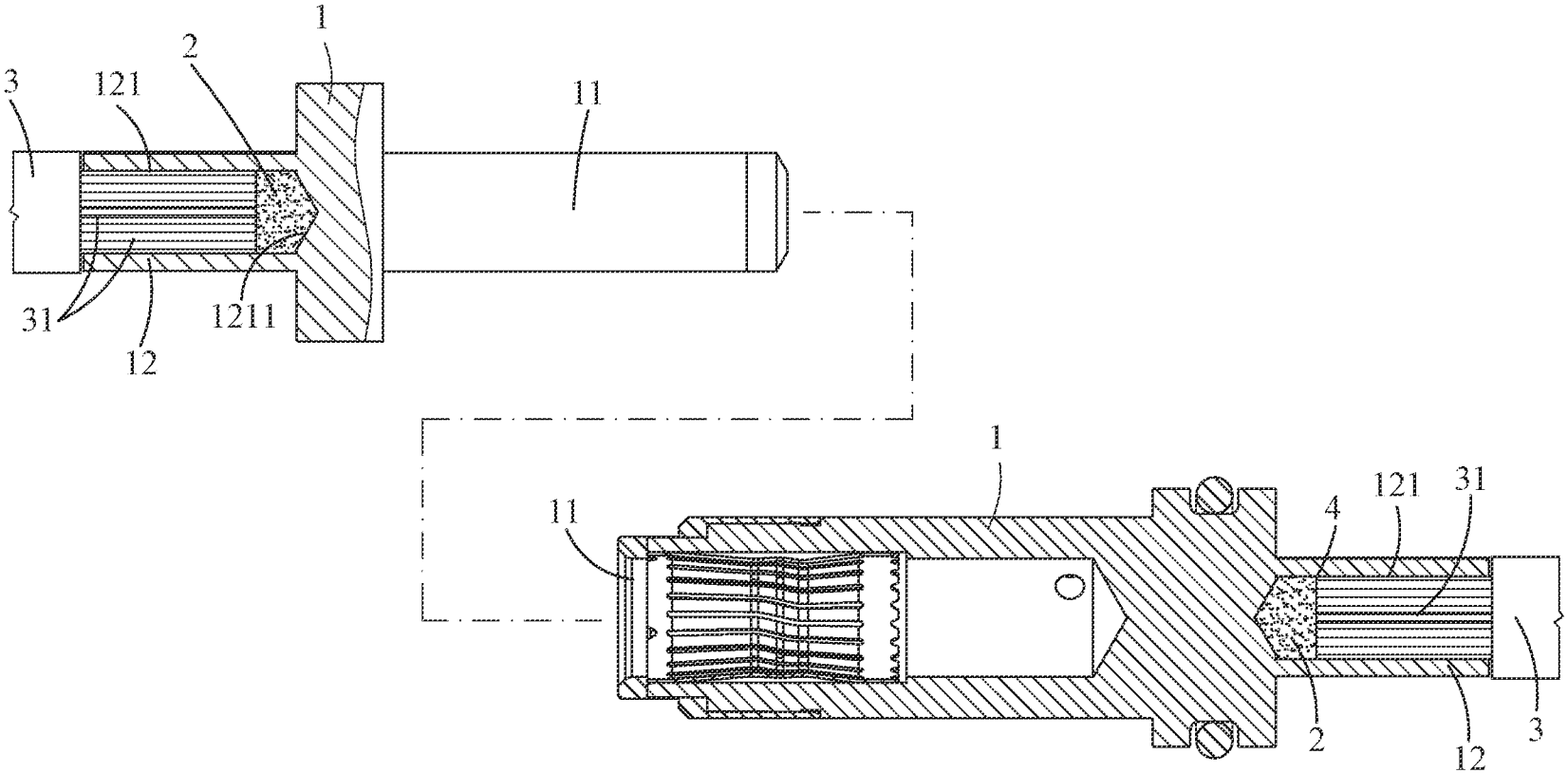
FIG. 9 illustrates a side view showing that the electrical connector of an exemplary embodiment serving as a plug-type electrical connector and a socket-type electrical connector are to be mated with each other.
Figure 10:
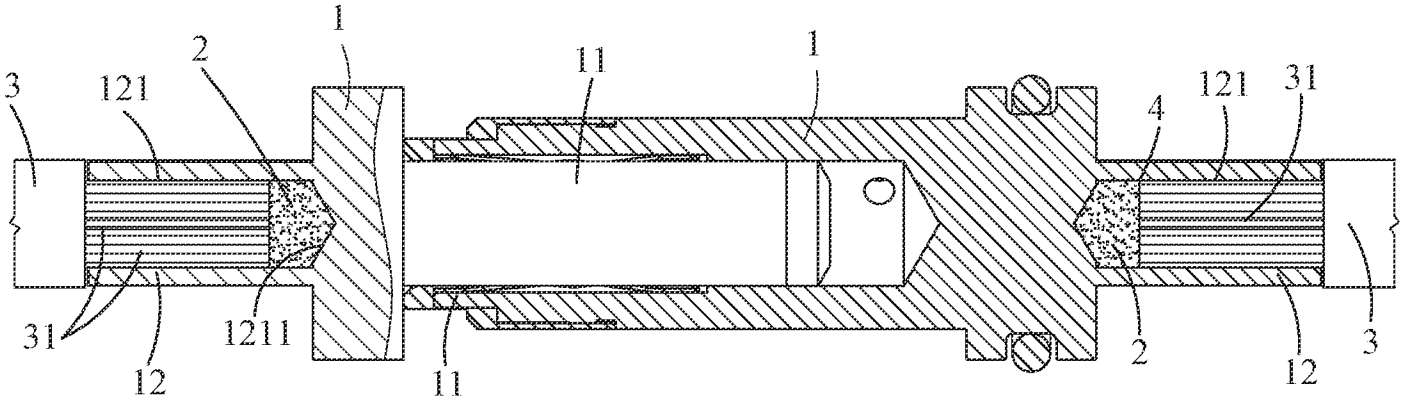
FIG. 10 illustrates a side view showing that the electrical connector of an exemplary embodiment serving as a plug-type electrical connector and a socket-type electrical connector are mated with each other.

Please refer to FIGS. 1 to 4. An electrical connector serving as a socket-type electrical connector (namely, a socket-type electrical connector) according to a first embodiment of the instant disclosure is illustrated. FIG. 1 illustrates a perspective view of the socket-type electrical connector of the first embodiment. FIG. 2 illustrates an exploded view of the socket-type electrical connector of the first embodiment. FIG. 3 illustrates a side view showing that the socket-type electrical connector is to be assembled of the first embodiment. FIG. 4 illustrates a side view showing the assembled socket-type electrical connector of the first embodiment. Please further refer to FIGS. 5 to 8. An electrical connector serving as a plug connector (namely, a plug-type electrical connector) according to a second embodiment of the instant disclosure is illustrated. FIG. 5 illustrates a perspective view of the plug-type electrical connector of the second embodiment. FIG. 6 illustrates an exploded view of the plug-type electrical connector of the second embodiment. FIG. 7 illustrates a side view showing that the plug-type electrical connector of the second embodiment is to be assembled. FIG. 8 illustrates a side view showing the assembled plug-type electrical connector of the second embodiment. In these embodiments, the electrical connector is served as a receptacle connector or a plug connector. In these embodiments, the electrical connector comprises a conductive body 1, a conductive medium 2, and a cable member 3. In one embodiment, the electrical connector may be served as an automobile (such as electric vehicle and hybrid vehicle) electrical connector utilized in a charging gun, but embodiments are not limited thereto; in some embodiments, the electrical connector may be served as an electrical connector for large-current transmission in other fields. Please further refer to FIGS. 9 and 10. The plug-type electrical connector and the socket-type electrical connector may be mated with each other for power transmission.

In the first embodiment, one of two ends of the conductive body 1 comprises an insertion portion 11, and the other end of the conductive body 1 comprises a wire-connection post 12. The wire-connection post 12 has a groove 121.

In the first embodiment, the conductive medium 2 is disposed in the groove 121.

In the first embodiment, the cable member 3 comprises a plurality of core wires 31 (threads). The core wires 31 are inserted into the groove 121. The conductive medium 2 is distributed over a space 32 between the core wires 31 as well as a space between the core wires 31 and the groove 121. Therefore, there is almost no air exists in the groove 121.

In the first embodiment, more specifically, the conductive medium 2 may be made of metal. The conductive medium 2 may be a solid medium, a fluid (semifluid) medium, or a gas medium. In this embodiment, the conductive medium 2 may be copper powder, especially in one embodiment, may be pure red copper powder. Alternatively, the conductive medium 2 may be a conductive paste.

In the first embodiment, more specifically, the conductive body 1 is a cylinder, and the wire-connection post 12 is another cylinder at the other end of the conductive body. A surface of the wire-connection post 12 has a small vent hole 122 communicating with the groove 121. It is understood that, the drain hole for the connector known to the inventor is provided for draining the electroplating out of the connector and not to retain in the connector. Conversely, in this embodiment, the vent hole 122 is served as air exhaust. Moreover, in embodiments being devoid of the vent hole 122, the air may be exhausted out of the connector from the opening of the groove 121.

After the conductive medium 2 is filled in the groove 121, the core wires 31 of the cable member 3 can then be inserted into the groove 121. The core wires 31 (multicore wires) are small rods which are flexible. Moreover, the core wires 31 are arranged together. It is understood that, even though the core wires 31 are arranged together, spaces 32 would be formed between the core wires 31, indicating the existence of air. Therefore, a riveting process is applied to exhaust the air (a cold work compression is applied to compress the wire-connection post 12 with the core wires 31 to form one member). Moreover, the conductive medium 2 fills into the spaces 32 between the core wires 31 and the space in the groove 121, so that the air inside the groove 121 and between the wire cores 31 can be exhausted (namely, the air wall is vanished). Hence, the conductive medium 2 is distributed over the spaces, thereby allowing the whole cross section at the connection portion between the conductive body 1 and the cable member 3 to be conductive. Accordingly, the device has a low resistance so as to be applied widely.

It is understood that, in the foregoing embodiments, the cable member 3 comprises the core wires 31 (multicore wires), but embodiments are not limited thereto; in some embodiments, the cable member 3 may comprise a core wire 31 (single core wire).

In the process of coupling several conductive pieces/materials (the conductive body and the cable member in this embodiment) with each other, firstly, air is drained out and the conductive medium 2 is filled into the conductive pieces/materials. Next, a riveting compression procedure is applied to tighten the conductive pieces/materials with each other. The jacket at one end of the cable member 3 is removed to expose the core wires 31. The surfaces of the core wires 31 are in contact with the inner surface of the groove 121 for electrical contact. Therefore, as compared with the connector devoid of the conductive medium, in this embodiment, the whole cross section at the connection portion between the conductive body 1 and the cable member 3 is conductive. The fine pure red copper powder is filled into the groove 121 to exhaust the air in the groove 121 and between the core wires 31. Hence, the conductive medium 2 can be distributed over the spaces at the connection portion between the conductive body 1 and the cable member 3, and all portions at the cross section of the connection portion are conductive.

During the large-current transmission, it is understood that the temperature of the conductive body 1 increases greatly along with the increase of the resistance of the conductive body 1. Moreover, it should be noted that, air is an insulation medium, rather than a conductive medium. As a result, the cross section at the connection portion of the connector devoid of the conductive medium 2 is divided into several conductive portions. On the other hand, when the air is exhausted from the space 32 between the core wires 31 and the space between the core wires 31 and the groove 121, the air wall is vanished and the conductive path (current path) can be prevented from being divided into several bypasses to increase the resistance apparently. It can be seen from FIG. 4, without the conductive medium 2, the end portions of the core wires 31, the upper inner surface of the groove 121, and lower inner surface of the groove 121 will form different conductive paths during the power transmission, thereby increasing the resistance of the device, and thus causing apparent temperature increase of the connector.

In the first embodiment, more specifically, a geometrical shape is formed on the surface of the wire-connection post 12 through riveting, and the geometrical shape may be a hexagonal shape, a rectangular shape, or other geometrical shapes. Moreover, when the surface of the wire-connection post 12 is riveted, some of the conductive medium 2 and the air in the groove 121 may be drained out of the device from the vent hole 122.

In the first embodiment, more specifically, an inner side of the groove 121 has a cone-shaped slot 1211, and the conductive medium 2 is disposed in the cone-shaped slot 1211. More specifically, in this embodiment, when the wire-connection post 12 is drilled to form the groove 121, the cone-shaped slot 1211 is formed at the inner side of the groove 121.

Figure 11:
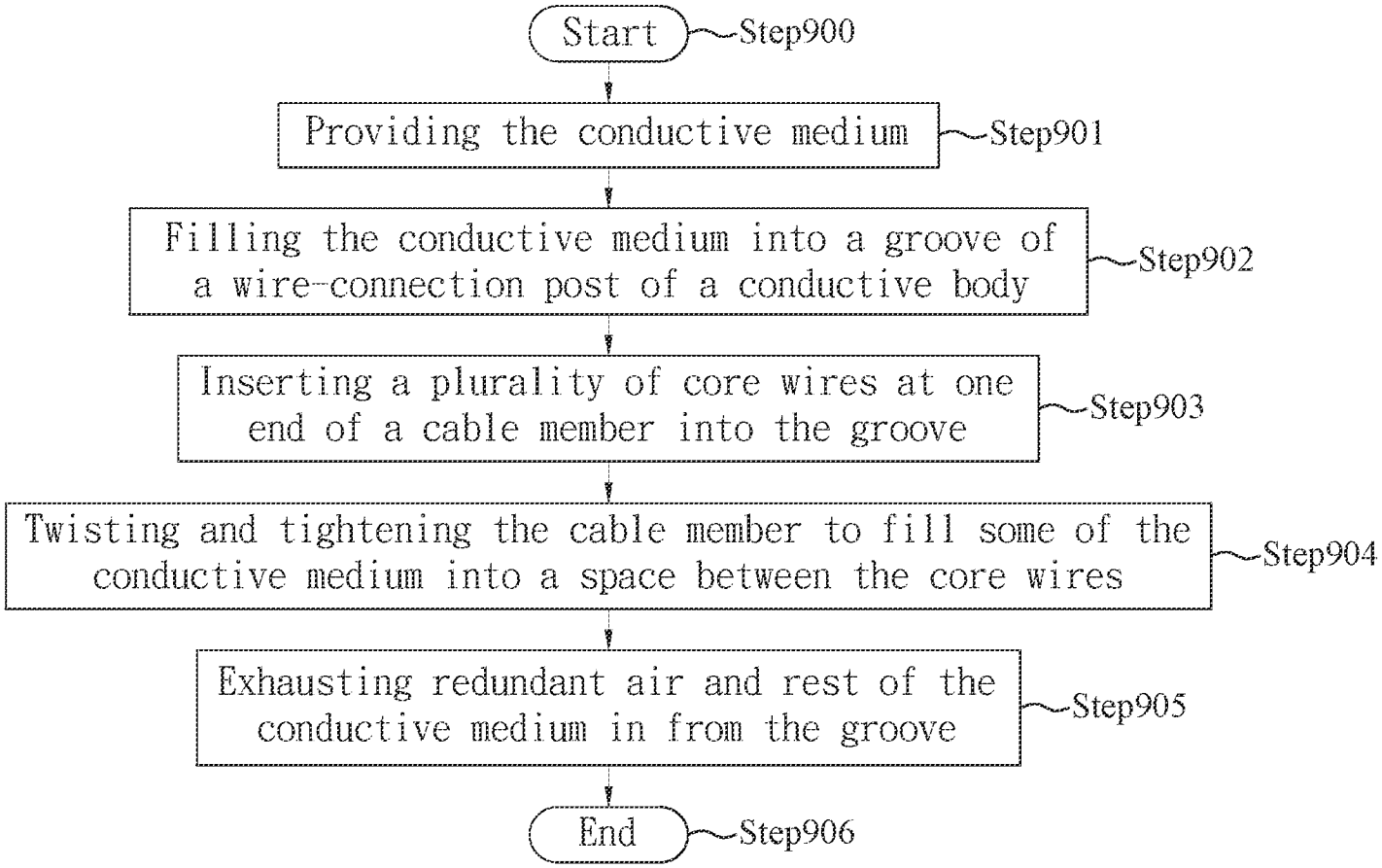
FIG. 11 illustrates a flowchart of an electrical wire connection method for connecting electrical connectors with each other.

Please refer to FIG. 11. An electrical wire connection method for connecting electrical connectors with each other is illustrated. FIG. 11 illustrates a flowchart of an electrical wire connection method for connecting electrical connectors with each other. Please further refer to FIGS. 3 and 11, in the third embodiment, the electrical wire connection method comprises following steps.

Step (Step900): start.

Step (Step901): providing the conductive medium 2.

Step (Step902): filling the conductive medium 2 into a groove 121 of a wire-connection post 12 of a conductive body 1.

Step (Step903): inserting a plurality of core wires 31 at one end of a cable member 3 into the groove 121.

Step (Step904): twisting and tightening the cable member 3 to fill some of the conductive medium 2 into spaces 32 between the core wires 31.

Step (Step905): exhausting redundant air and rest of the conductive medium 2 in from the groove 121.

Step (Step906): end.

In one embodiment, after the step of exhausting redundant air and rest of the conductive medium 2 from the groove 121, the wire-connection post 12 is riveted to fasten the core wires 31. In the case that the conductive medium 2 is the pure red copper powder, the filling amount in the groove 121 is about 0.4 grams, about one-third of the depth of the groove 121, and higher than the vent hole 122.

During the twisting step, the cable member 3 or the conductive body 1 are twisted clockwise or counterclockwise, so that the copper powder can be filled into the space between the cores to exhaust airs. Next, the conductive body 1 together with the cable member 3 are riveted and wire bonded.

In one or some embodiments, an air wall 4 is formed between an inner side of the groove 121 and the core wires 31. Specifically, in the embodiments, end portions of the core wires 31 flush with each other, and a space is between the end portions of the core wires 31 and the inner side of the groove 121. When the conductive medium 2 is not filled into the space yet, the space forms the air wall 4. In this embodiment, the conductive medium 2 is filled into the air wall 4 to exhaust redundant air. The resistance of the connector with the conductive medium 2 is 1.73 mΩ, and the resistance of the connector without the conductive medium 2 is 2.51 mΩ. Accordingly, when the connector with the conductive medium 2 is provided for large-current transmission, the connector has low resistance so as to avoid the increase of temperature.

According to one or some embodiments of the instant disclosure, the conductive medium is distributed over spaces between the core wire(s) and the groove, so that the conductive medium is properly distributed in the groove and in contact with the core wire(s). Hence, the spaces are filled by the conductive medium, thereby allowing the whole cross section at the connection portion between the conductive body and the cable member to be conductive. Air is exhausted out of the groove. Accordingly, when the cable member used for large-current performs power transmission, problems of increased resistance and temperature can be effectively solved.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector, comprising:

a conductive body, wherein one of two ends of the conductive body comprises an insertion portion, and the other end of the conductive body comprises a wire-connection post, the wire-connection post has a groove;

a conductive medium disposed in the groove; and a cable member comprising a plurality of core wires inserted into the groove, wherein the conductive medium is distributed over a space between the core wires as well as a space between the core wires and the groove.

2. The electrical connector according to claim 1, wherein the conductive medium is made of metal.

3. The electrical connector according to claim 2, wherein the conductive medium is copper powder.

4. The electrical connector according to claim 1, wherein the conductive medium is a solid medium, a fluid medium, or a gas medium.

5. The electrical connector according to claim 1, wherein a surface of the wire-connection post has a vent hole communicating with the groove.

6. The electrical connector according to claim 1, wherein a geometrical shape is formed on a surface of the wire-connection post through riveting.

7. The electrical connector according to claim 1, wherein an inner side of the groove has a cone-shaped slot, and the conductive medium is disposed in the cone-shaped slot.

8. An electrical connector, comprising:

a conductive body, wherein one of two ends of the conductive body comprises an insertion portion, and the other end of the conductive body comprises a wire-connection post, the wire-connection post has a groove;

a conductive medium disposed in the groove; and a cable member comprising a core wire inserted into the groove, wherein the conductive medium is distributed over a space between the core wire and the groove.

9. The electrical connector according to claim 8, wherein the conductive medium is made of metal.

10. The electrical connector according to claim 9, wherein the conductive medium is copper powder.

11. The electrical connector according to claim 8, wherein the conductive medium is a solid medium, a fluid medium, or a gas medium.

12. The electrical connector according to claim 8, wherein a surface of the wire-connection post has a vent hole communicating with the groove.

13. The electrical connector according to claim 8, wherein a geometrical shape is formed on a surface of the wire-connection post through riveting.

14. The electrical connector according to claim 8, wherein an inner side of the groove has a cone-shaped slot, and the conductive medium is disposed in the cone-shaped slot.

15. An electrical wire connection method for connecting electrical connectors with each other, comprising:

providing a conductive medium;

filling the conductive medium into a groove of a wire-connection post of a conductive body;

inserting a plurality of core wires at one end of a cable member into the groove;

twisting and tightening the cable member to fill some of the conductive medium into a space between the core wires; and exhausting redundant air and rest of the conductive medium from the groove.

16. The wire connection method according to claim 15, wherein after the step of exhausting redundant air and rest of the conductive medium from the groove, the wire-connection post is riveted to fasten the core wires.

17. The wire connection method according to claim 15, wherein an air wall is formed between an inner side of the groove and end portions of the core wires, and the conductive medium is filled into the air wall.

* * * * *